US005935000A

United States Patent [19]

Sanchez, III et al.

[11] Patent Number: 5,935,000

[45] Date of Patent: Aug. 10, 1999

[54] SECURE GAMING TICKET AND VALIDATION METHOD FOR SAME

[75] Inventors: Cayetano Sanchez, III; Walter Szrek, both of East Greenwich, R.I.

[73] Assignee: GTECH Rhode Island Corporation, West Greenwich, R.I.

[21] Appl. No.: 09/034,379

[22] Filed: Mar. 4, 1998

[51] Int. Cl.[6] ..... A63F 9/22

[52] U.S. Cl. ..... 463/17

[58] Field of Search ..... 273/269, 148 R, 273/139, 138.2; 463/16, 17; 235/375; 283/901, 903

[56] References Cited

U.S. PATENT DOCUMENTS 4,191,376 3/1980 Goldman et al. .
4,398,708 8/1983 Goldman et al. .
4,725,079 2/1988 Koza et al. .
5,317,135 5/1994 Finocchio ..... 463/17
5,398,932 3/1995 Eberhardt et al. ..... 463/17 X
5,505,449 4/1996 Eberhardt et al. ..... 463/17 X
5,613,680 3/1997 Groves et al. ..... 463/17 X
5,749,784 5/1998 Clapper, Jr. ..... 463/17
5,772,510 6/1998 Roberts ..... 463/17
5,791,990 8/1998 Schroeder et al. ..... 463/17

*Primary Examiner*—Raleigh W. Chiu
*Attorney, Agent, or Firm*—Fish & Richardson P.C.

[57] ABSTRACT

A secure gaming ticket and validation method for gaming tickets includes storing validation information and ticket identification information in different locations. The stored information is then encoded to create an interim type of data, which is combined with prize information data to create a validation signature. The validation signature determines a win status of gaming ticket.

35 Claims, 4 Drawing Sheets

SECURE GAMING TICKET AND VALIDATION METHOD FOR SAME

BACKGROUND OF THE INVENTION

The invention relates to the field of lottery ticket security and, in particular, to a secure lottery ticket and method for storing information on lottery tickets in a secure manner.

For most instant lottery games, the tickets which are sold include a laminated paper portion. The winning game numbers or symbols are printed on the laminated paper on the front of the ticket and covered with a scratch-off material, typically a latex compound. Lottery tickets are normally printed in groups of 200 to 500, known as "books" or "packets," with consecutive book numbers printed on the backs of the tickets. The book number is used by the lottery administration for inventory control purposes.

Instant lottery tickets are also usually provided with a validation number printed on the lottery ticket which is not related to the book number. This validation number is concealed by, e.g., tear-off coverings, removable coatings, or special printing inks. The validation number is used to determine whether a ticket holder is a winner or loser after the lottery agent removes the concealment by comparing the validation number against a list of winning numbers or other winning values. If the validation number matches a winning number, then the ticket holder is entitled to receive a prize.

For most implementations of instant ticket lottery systems, information regarding the win status of an instant ticket is found in two places on the ticket, namely one in a clearly visible location on the face of the ticket and the other hidden under latex, also preferably on the face of the ticket. The operator and/or ticket agent must remove the latex to identify and manually key in information hidden thereunder into a terminal (i.e., computer) in order to determine the win status of the ticket. This process is both time consuming and subject to errors.

In addition, the operator and/or ticket agent can obtain information that, in certain situations, compromises the integrity of the instant ticket lottery system.

Thus, control of information concerning validation of instant lottery tickets is important to the security of the game and to ensure public confidence in the system. Validation of tickets by lottery agents should be done quickly and efficiently, and in a manner which reduces the opportunity for lottery fraud.

SUMMARY OF THE INVENTION

A secure validation system for lottery tickets includes storing validation information in a first location and storing ticket information at a second location. The validation information and the ticket identification information are encoded to produce an interim type of data which is combined with prize information data to create a validation signature. By comparing the validation signature with a specific value, a particular ticket's validity is determined.

In general, in one aspect, the invention features a secure validation method for determining a win status of gaming tickets including the steps of storing validation information in a first location, storing ticket identification information in a second location, and encoding the validation information and the ticket identification information to create an interim type of data. The interim type of data is combined with prize information data to create a validation signature, which determines the win status of a gaming ticket.

Implementations of the invention may also include one or more of the following features. The first location for storing validation information may be a location other than the gaming ticket and the second location for storing ticket identification information may be the gaming ticket.

The interim type of data may describe a format for variable data of probability games printed on the gaming ticket. The validation signature may describe a combination of gaming symbols on the gaming ticket.

The validation information may vary as a function of the ticket identification information, for different ranges of books within an instant game type, or for different instant games. The validation signature may vary as a function of the ticket identification information, for different ranges of books within an instant game type, or for different instant games. The encoding step may be a function of the ticket identification information, or may vary with different ranges of books within an instant game type or for different instant games.

The step of combining the interim type of data with prize information data to create a validation signature may be a function of the ticket identification information, or may vary for different ranges of books within an instant game or for different instant games.

In general, in another aspect, the invention features a secure validation method for determining a win status of gaming tickets including the steps of storing validation information in a first location, storing prize information data in a second location, and encoding the validation information and the prize information data to create an interim type of data. The interim type of data is combined with ticket identification information to create a validation signature, which determines the win status of a gaming ticket.

Implementations of the invention may also include one or more of the following features. The first location for storing validation information may be a location other than the gaming ticket and the second location for storing prize information data may be the gaming ticket. The interim type of data may describe a format for variable data of probability games printed on the gaming ticket.

The validation signature may describe a combination of gaming symbols on the gaming ticket. The validation information may vary as a function of the prize information data, for different ranges of books within an instant game type, or for different instant games. The validation signature may vary as a function of the prize information data, for different ranges of books within an instant game type, or for different instant games. The encoding step may be a function of the prize information data, or may vary with different ranges of books within an instant game type or for different instant games.

The step of combining the interim type of data with ticket identification information to create a validation signature may be a function of the prize information data, or may vary for different ranges of books within an instant game or for different games.

In general, in anther aspect, the invention features, in combination, a gaming ticket and a validation device. The gaming ticket has located thereon ticket identification information and prize information data, and the validation device stores validation information. The ticket identification information is combined with the validation information stored by the validation device at a location other than the gaming ticket to create an interim data which combines with the prize information data to determine a win status of the gaming ticket.

In general, in another aspect, the invention features, in combination, a gaming ticket and a validation device. The gaming ticket has located thereon ticket identification information and prize information data, and the validation device stores validation information. The prize information data is combined with the validation information stored by the validation device at a location other than the gaming ticket to create an interim data which combines with the ticket identification information to determine a win status of the gaming ticket.

In general, in another aspect, the invention features a secure validation method for determining a win status of gaming tickets including the steps of storing validation information in a first location, storing ticket identification information in a second location, and encoding the validation information and the ticket identification information to create an interim type of data. The interim type of data determines the win status of a gaming ticket.

The present invention provides a lottery ticket and system which allows for "one pass" keyless validation of instant gaming tickets in a highly secure manner. One pass keyless validation allows a lottery agent to scan or enter a number or code from a ticket into a terminal in order to validate the ticket. The secure validation system combines information printed on the ticket (i.e., as a bar code or as a string of characters printed with ink) and information provided from a central location to determine secret validation information.

The system of the present invention may be used for one-step ticket validation, for describing ticket layout information, or for any other information which must be kept secret. In particular, the system may be used for probability game tickets, in which players may remove a latex coating from only a limited number of covered spaces on the ticket.

By separating the information required to validate an instant ticket between a first location, such as a host computer, and a second location, such as the instant ticket itself, the present invention has the advantage of limiting the possibility of tampering to recover the secret information which previously had been stored only on the ticket. The higher level of security which is achieved will significantly reduce lottery fraud.

Other features and advantages of the invention will become apparent from the following detailed description, and from the claims.

DESCRIPTION OF THE PREFERRED EMBODIMENTS

Figure 1:
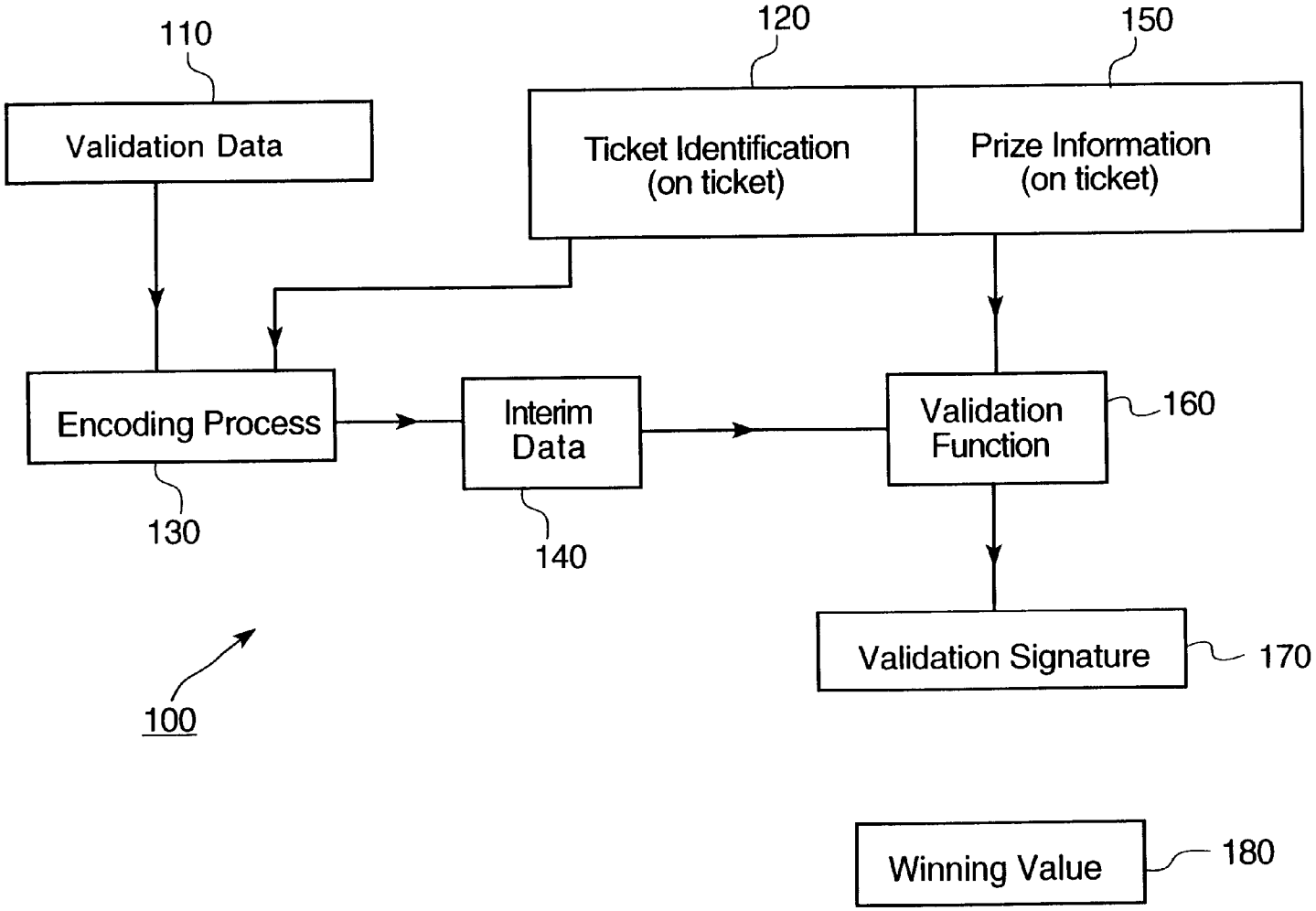
FIG. 1 is a flow diagram illustrating the secure validation system.

The present invention describes a transaction method which provides for stringent integrity and security of information stored on instant lottery tickets "in the clear." The term "in the clear" refers to information which is openly printed on the ticket and is visible to anyone, but which is meaningless without proper translation or interpretation. An example of such a representation of information is a bar code.

As the requirements for lottery and other gaming applications have evolved in recent years, secure validation of lottery and gaming tickets is playing an ever increasing role. Instant lottery tickets require information which describes the ticket layout for the instant game to be printed in the clear. However, the amount of information provided on the ticket should be limited to prevent an individual from determining information which is intentionally kept secret. By separating the information which is kept secret from the information which is displayed in the clear, the security of the system is enhanced, thereby reducing lottery fraud. The secure ticket and validation system of the present invention combines the information which is printed on the ticket and information which is provided from a location other than the ticket to determine secret validation information by the local lottery agent or lottery administration.

The secure validation system combines information printed on the ticket (e.g. a bar code or a string of characters printed with ink) and information provided from a remote location to determine secret validation information. In a preferred embodiment, the secure validation system uses three types of data: (1) validation data, which is stored in a central terminal; and (2) ticket identification data and (3) prize identification data, which are printed on the ticket in the clear.

In the present invention, the validation data is stored by a validation device and used by an encoding algorithm along with the ticket identification data to create an interim data result. By combining the interim data with prize identification data, a validation signature is produced which determines whether a ticket is a valid ticket and if so, any corresponding prize. The validation data may be transmitted to validation terminals on an as needed basis.

The system of the present invention stores ticket validation data at a first location and ticket identification data at a second location. The validation data is then used by an encoding algorithm along with the ticket identification data to create an interim data result. By combining the interim data result with prize identification data that is printed on the ticket in the clear, a validation signature is produced which determines whether a ticket is a winning ticket and any corresponding prize for the winning ticket. The validation data is controlled from the first location, which is preferably a central terminal, to be transmitted to individual validation terminals at local sites on an as needed basis.

The instant ticket and security system of the present invention contains numeric information which may include three parts. The first two parts, ticket identification data and prize information data, are stored on the instant lottery ticket. The third part is validation data, which is preferably stored in one or more validation terminals at a separate location.

The term ticket identification data refers to the information which uniquely specifies an individual ticket in a lottery game system. For example, a lottery ticket may use the combination of game number, book number and individual ticket number to comprise the ticket identification data which is necessary to identify a single individual ticket in a particular instant lottery game.

The term prize information data refers to information which, when combined with validation data and ticket identification data in a particular manner, will determine an individual ticket's prize code, i.e. whether a given ticket is a winner or a loser. It may also determine which information on an individual ticket is winning information.

The term validation data as used herein refers to that data which is used by an encoding algorithm along with the ticket identification data to produce an interim result, and which can be combined with prize information data to determine a prize code for an individual ticket. In an alternative embodiment, the validation data can be combined with prize information data to produce the interim result, which is then combined with ticket identification data to validate a ticket. The validation data may be related to the ticket identification data or prize information data, or a combination of these, to be used in the encoding algorithm to produce the interim result. The validation data for all tickets is stored and known at a first location and can be transmitted to local validation terminals on an as needed basis. The validation data may vary for different sets of instant lottery ticket books.

The term validation signature refers to data which is a result of the combination of the validation data, the ticket identification data and the prize information data. The combined information produces a specific value which can be used to describe or specify a particular type of information for a particular ticket, such as a prize code, game data area layouts, winning fields in a ticket, layout of symbols on a ticket, etc., or any other specific information which can be attributed to a single individual ticket and which is used to distinguish that individual ticket from all other tickets. Validation signature values can vary according to each game, a single book, or a range of books.

Figure 2:
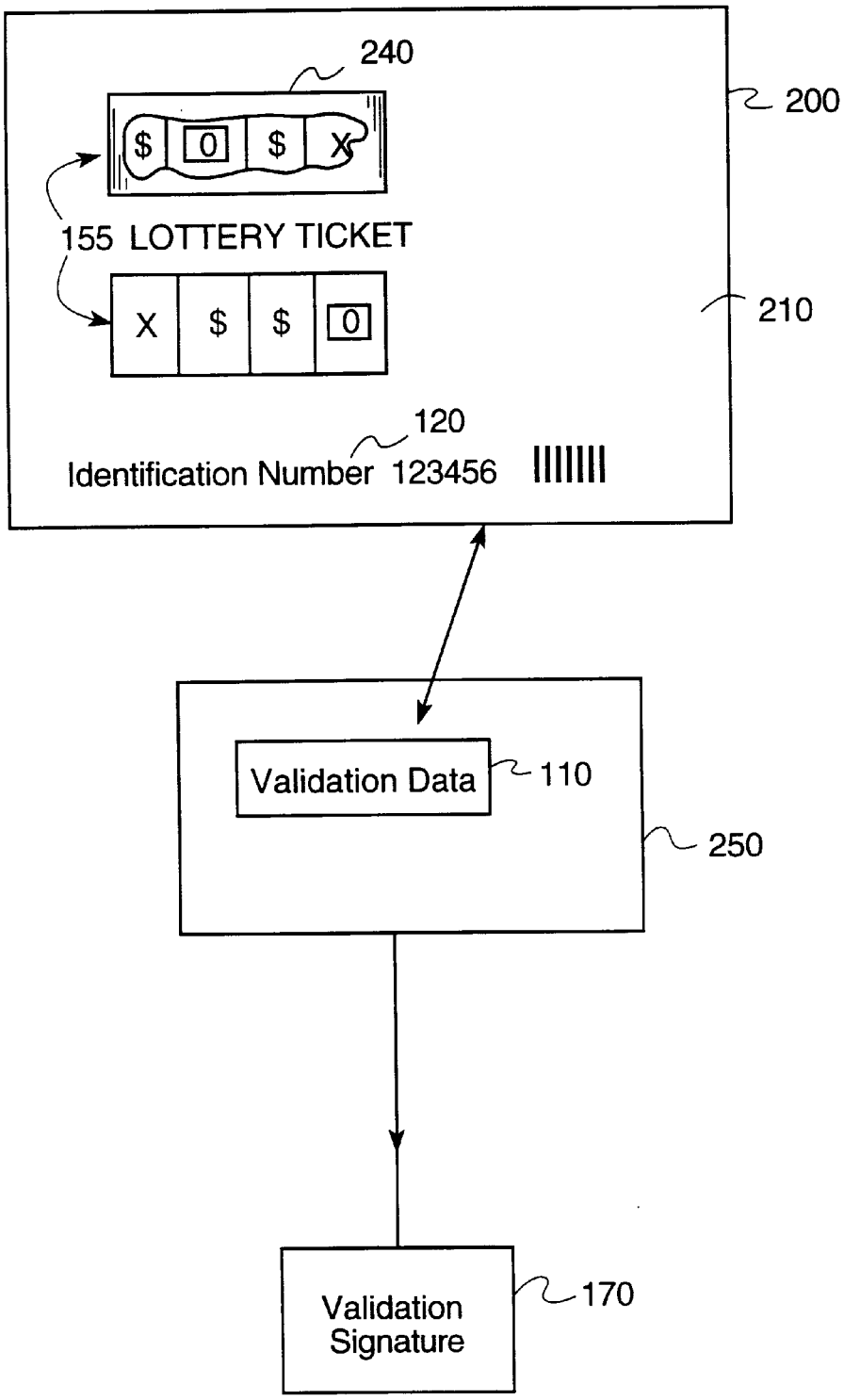
FIG. 2 is a plan view of a lottery ticket and validation system.

Referring to FIGS. 1 and 2, the secure lottery ticket validation system and lottery ticket of the present invention are shown. The secure validation system 100 includes validation data 110 stored at a first location and ticket identification information 120 stored at a second location, preferably on the ticket, which are combined through an encoding process 130 to create an interim type of data 140. Interim data 140 is combined with the prize information data 150 in a validation function 160 to create a validation signature 170. From the validation signature 170, the validity of an individual ticket can be determined by comparing the signature 170 to a specific winning value 180.

An individual lottery ticket 200 has a ticket face 210 on which ticket identification information 120 is printed in the clear. The ticket identification information 120 may include bar codes, serial numbers, or various strings of visible characters. Lottery ticket 200 also includes game indicia 155 printed on a face 210 of the ticket 200. Currently, game indicia 155 is typically covered by a scratch-off material 240, such as a latex covering, which can be removed by a player in order to reveal game indicia 155 for an individual game. The game indicia 155 win status corresponds to the validation signature 170.

Figure 3:
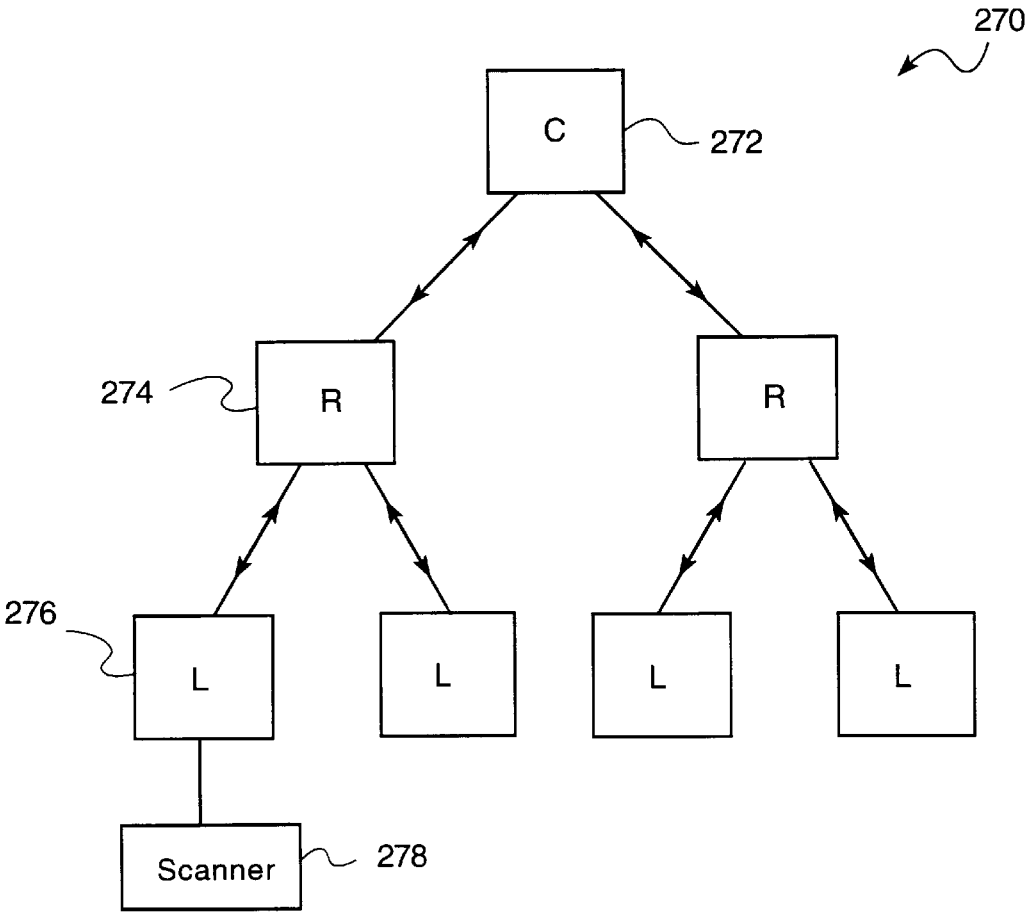
FIG. 3 illustrates a computer network which may be used to store validation data.

The secret validation data 110 is stored at a first location, which can be a validation device 250. The validation device 250 may include any means for storing information, such as charts, central computer terminals, personal computers, laptop units, point of sale terminals, lottery terminals, instant ticket validators, etc. As long as the validation data 110 is stored by the validation device 250 at a location other than on the lottery ticket 200, the security of the system 100 may be maintained. For example, FIG. 3 illustrates a computer network 270 which can be used to store validation data 110. The network 270 includes a central terminal 272 connecting to regional terminals 274, which in turn connect to numerous local or point of sale terminals 276. The validation data 110 can be stored at any of these locations, with retrieval of the validation data 110 from the central terminal 272 or regional terminals 274 on an as needed basis by the local lottery agent.

In one embodiment, the secret validation data 110 and the ticket identification information 120 are the inputs to an encoding process 130. Ticket identification information 120 is input by a local lottery agent or by the lottery administration when an individual player presents a ticket 200 for validation and/or collection of a prize. The ticket identification information 120 is entered by the agent via a scanner 278 at a local terminal 276 to send the information from the ticket which is stored, for example, as a bar code or magnetic strip, to be used in the encoding process 130 within the computer network 270.

The ticket identification information 120 and validation data 110 are encoded through processes known in the art, such as Triple DES (Data Encryption Standard) or other encryption algorithms, to generate an interim type of data or result 140. Such encryption algorithms may involve processing data and a secure key through an algorithm to obtain encrypted data. The data original data may then be obtained by applying the secure key to the encrypted data.

System 100 can be designed so that the validation data 110 is communicated from the validation device 250 on an as needed basis, i.e., when a local lottery agent requests information to be encoded with individual ticket identification information 120.

The interim data 140 from the encoding process 130 is then combined with the prize information data 150 located on the lottery ticket 200. This is preferably accomplished through the use of a validation function 160, which may be a simple mathematical function, such as modular addition. The combination of the prize information data 150 and the interim data 140 creates a validation signature 170. By comparing the validation signature 170 with a specific predetermined value 180 or set of values, the agent or administration can determine whether an individual ticket 200 is a valid lottery ticket.

For example, a validation signature 170 having a value of zero (0) might be used to indicate that a given ticket 200 is a low tier prize winner. The specific predetermined values which are used to test the validation signature 170 may be unique for each game, a range of lottery books, or a single lottery book. For example, a value of zero (0) might indicate low tier winners for all tickets having ticket numbers ending in zero (0), and the value one (1) may indicate low tier winners for all tickets having ticket numbers ending with the number one (1). The value of the validation signature 170 may also describe how data is printed on the game playing area on the ticket 200, and therefore show which combination of uncovered spaces identify a winning ticket. When the validation signature 170 is used to describe the layout of the symbols on the game playing area, the present invention supports probability games.

In this manner, an individual player can bring the lottery ticket 200 to a local lottery agent for validation after removing the scratch-off material 240. The lottery agent can quickly enter the ticket identification information on site to be combined with the validation data 110 from a central terminal or validation device 250. After the information is combined, the resulting validation signature 170 will allow the lottery agent to determine whether the ticket which has been presented is a valid ticket and what prize corresponds to the ticket.

The present invention improves the validation process for instant lottery ticket games by providing a higher level of security for validating instant lottery tickets. The requirement of latex removal by the local validation terminal operator in order to read or reveal validation data on an individual ticket is eliminated, thereby reducing the amount of time required to validate instant lottery tickets. Further, additional types of lottery games, such as probability games which typically require higher security levels, can be supported through the present invention. At the same time, the invention does not significantly increase communications costs compared to instant ticket validation when the system is applied to off-line systems.

The present invention can be applied to on-line terminals which are used to validate instant tickets. In addition, the present invention can be implemented in existing terminals and terminal systems without any hardware upgrades. By separating the information required to validate an instant ticket between a first location, such as a host computer, and a second location, such as the instant ticket itself, the present invention limits the possibility of tampering to recover the secret information which previously had been stored on the ticket. The higher level of security which is achieved will potentially avoid lottery fraud.

Figure 4:
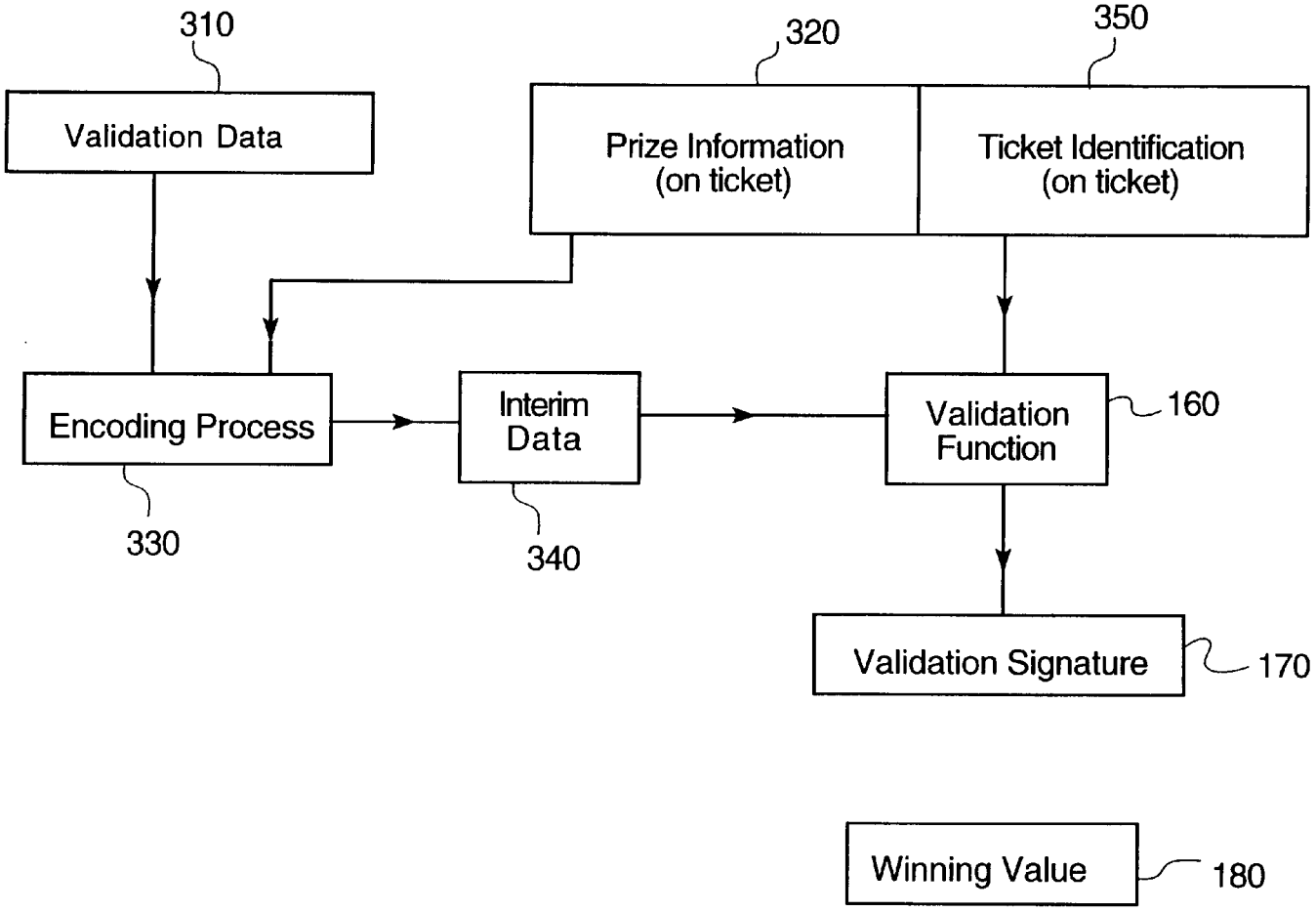
FIG. 4 is a flow diagram illustrating an alternative embodiment of the secure validation system.

It should be appreciated that variations of the above invention can be made. These include varying the validation data, the validation signature, the encoding process, the function of combining the first interim data with prize information, and the validation function as a function of ticket information data within a book, for different ranges of books within the same instant lottery type game, for different instant lottery games, and for any combination of the above. For example, FIG. 4 shows that the prize information data 320 which is stored on the ticket can also use the above described method of being combined with the validation data 310 stored at a location other than the ticket 200 in the encoding process 330. In this manner, the ticket identification information 350 can then be combined with the result 340 from the encoding step to create the validation signature for an individual ticket.

Further, the encoding process can be used to describe information such as the location of winning symbols under the latex coating. In addition, the system may be used with both pull tab and instant tickets.

Other embodiments are within the scope of the following claims.

What is claimed is:

1. A secure validation method for determining a win status of gaming tickets comprising the steps of:

storing validation information in a first location;

storing ticket identification information in a second location;

encoding said validation information and said ticket identification information to create an interim type of data; and combining said interim type of data with prize information data to create a validation signature;

wherein said validation signature determines the win status of a gaming ticket.

2. The secure validation method of claim 1 wherein said first location for storing validation information is a location other than said gaming ticket and said second location for storing ticket identification information is said gaming ticket.

3. The secure validation method of claim 1 wherein said interim type of data describes a format for variable data of probability games printed on said gaming ticket.

4. The secure validation method of claim 1 wherein said validation signature describes a combination of gaming symbols on said gaming ticket.

5. The secure validation method of claim 1 wherein said validation information varies as a function of said ticket identification information.

6. The secure validation method of claim 1 wherein said validation information varies for different ranges of books within an instant game type.

7. The secure validation method of claim 1 wherein said validation information varies for different instant games.

8. The secure validation method of claim 1 wherein said validation signature varies as a function of said ticket identification information.

9. The secure validation method of claim 1 wherein said validation signature varies for different ranges of books within an instant game type.

10. The secure validation method of claim 1 wherein said validation signature varies for different instant games.

11. The secure validation method of claim 1 wherein said encoding step is a function of said ticket identification information.

12. The secure validation method of claim 1 wherein said encoding step varies with different ranges of books within an instant game type.

13. The secure validation method of claim 1 wherein said encoding step varies for different instant games.

14. The secure validation method of claim 1 wherein said step o f combining said interim type of data with prize information data to create a validation signature is a function of said ticket identification information.

15. The secure validation method of claim 1 wherein said step of combining said interim type of data with prize information data to create a validation signature varies for different ranges of books within an instant game.

16. The secure validation method of claim 1 wherein said step of combining said interim type of data with said prize information data to create a validation signature varies for different instant games.

17. A secure validation method for determining a win status of gaming tickets comprising the steps of:

storing validation information in a first location;

storing prize information data in a second location;

encoding said validation information and said prize information data to create an interim type of data; and combining said interim type of data with ticket identification information to create a validation signature;

wherein said validation signature determines the win status of a gaming ticket.

18. The secure validation method of claim 17 wherein said first location for storing validation information is a location other than said gaming ticket and said second location for storing prize information data is said gaming ticket.

19. The secure validation method of claim 17 wherein said interim type of data describes a format for variable data of probability games printed on said gaming ticket.

20. The secure validation method of claim 17 wherein said validation signature describes a combination of gaming symbols on said gaming ticket.

21. The secure validation method of claim 17 wherein said validation information varies as a function of said prize information data.

22. The secure validation method of claim 17 wherein said validation information varies for different ranges of books within an instant game type.

23. The secure validation method of claim 17 wherein said validation information varies for different instant games.

24. The secure validation method of claim 17 wherein said validation signature varies as a function of said prize information data.

25. The secure validation method of claim 17 wherein said validation signature varies for different ranges of books within an instant game type.

26. The secure validation method of claim 17 wherein said validation signature varies for different instant games.

27. The secure validation method of claim 17 wherein said encoding step is a function of said prize information data.

28. The secure validation method of claim 17 wherein said encoding step varies with different ranges of books within an instant game type.

29. The secure validation method of claim 17 wherein said encoding step varies for different instant games.

30. The secure validation method of claim 17 wherein said step of combining said interim type of data with ticket identification information to create a validation signature is a function of said prize information data.

31. The secure validation method of claim 17 wherein said step of combining said interim type of data with ticket identification information to create a validation signature varies for different ranges of books within an instant game.

32. The secure validation method of claim 17 wherein said step of combining said interim type of data with ticket information to create a validation signature varies for different games.

33. A secure validation method for determining a win status of gaming tickets comprising the steps of:

storing validation information in a first location;

storing ticket identification information in a second location; and encoding said validation information and said ticket identification information to create an interim type of data;

wherein said interim type of data determines the win status of a gaming ticket.

34. In combination, a gaming ticket and a validation device, said gaming ticket having located thereon ticket identification information and prize information data, and said validation device storing validation information;

said ticket identification information combining with said validation information stored by said validation device at a location other than said gaming ticket to create an interim data which combines with said prize information data to determine a win status of said gaming ticket.

35. In combination, a gaming ticket and a validation device, said gaming ticket having located thereon ticket identification information and prize information data, and said validation device storing validation information;

said prize information data combining with said validation information stored by said validation device at a location other than said gaming ticket to create an interim data which combines with said ticket identification information to determine a win status of said gaming ticket.

* * * * *